US005487652A

United States Patent [19]

Shultz

[11] Patent Number: 5,487,652

[45] Date of Patent: Jan. 30, 1996

[54] FUEL FLOW STABILIZER

[75] Inventor: Gil F. Shultz, Novi, Mich.

[73] Assignee: SGS-Thomson Microelectronics, Inc., Carrollton, Tex.

[21] Appl. No.: 27,013

[22] Filed: Mar. 5, 1993

[51] Int. Cl.[6] ..... F02M 37/04

[52] U.S. Cl. ..... 417/543

[58] Field of Search ..... 417/543

[56] References Cited

U.S. PATENT DOCUMENTS

| | | | |
|---|---|---|---|
| 1,777,891 | 10/1930 | Pearson | 417/543 |
| 2,100,404 | 11/1937 | Mason et al. | 417/543 X |
| 2,269,625 | 1/1942 | Erickson | 417/543 |
| 2,565,374 | 8/1951 | Kitchel | 417/543 X |
| 3,292,661 | 12/1966 | Everett | 417/543 X |
| 4,260,333 | 4/1981 | Shillinger | 417/45 |
| 4,728,264 | 3/1988 | Tuckey | 417/44 |
| 4,756,291 | 7/1988 | Cummins et al. | 123/497 |
| 4,789,308 | 12/1988 | Tuckey | 417/44 |
| 4,926,829 | 5/1990 | Tuckey | 123/497 |
| 5,122,039 | 6/1992 | Tuckey | 417/543 X |
| 5,152,271 | 10/1992 | Matsumura | 417/543 |

OTHER PUBLICATIONS

*1992 Civic 3/4 Door Service Manual,* (American Honda Motor Co., Inc., 1991), pp. 11–111 and 11–112.

*Volkswagen Fox Service Manual* (Robert Bentley, Inc. 1992), pp. 5–9, 5–14, 5–20, 5–31, 5–45.

*Primary Examiner*—Richard E. Gluck

*Attorney, Agent, or Firm*—Richard A. Bachand; Rodney M. Anderson; Lisa K. Jorgenson

[57] ABSTRACT

A fuel delivery system in an engine is provided with a fuel flow stabilizing device for instantaneously providing a precise amount of fuel to the engine according to a particular fuel demand. The fuel flow stabilizing device has an accumulator device which stores a reserve amount of fuel under pressure and supplies or accepts excess fuel in response to a change in fuel pressure in the fuel delivery system. The accumulator device allows a simpler fuel pump motor and control system to be used as fuel pump response time requirements are reduced.

2 Claims, 5 Drawing Sheets

FUEL FLOW STABILIZER

BACKGROUND OF THE INVENTION

1. Field of the Invention

This invention relates to improvements in stabilizing fuel flow in a fuel delivery system and more particularly, to an apparatus for accurately and timely supplying fuel to an engine while reducing fuel pump response requirements. Specifically, this invention relates to an apparatus for stabilizing fuel flow in a fuel delivery system by providing an accumulator device within the fuel delivery system.

2. Relevant Background

An object of any fuel delivery system is to ensure that fuel demands are met with little or no lag time between demand for fuel and supply of that fuel to the injectors or carburetor of an engine. For example, when a car is at rest and then is accelerated rapidly, an relatively large demand for fuel is placed on a fuel pump. However, the fuel pump motor requires a certain amount of time to reach the pump speed required to supply the increased demand. The time between the demand and when the fuel pump has reached a speed necessary to supply the large amount of fuel is known as a latency period. The latency period depends on the particular fuel pump motor used and the rate of acceleration or deceleration. The problem with too little fuel being supplied to the fuel injectors during the latency period is that the vehicle cannot accelerate as quickly as possible. Thus, there is a decrease in acceleration performance of the vehicle.

Similar to acceleration, when a vehicle is decelerated rapidly, a relatively large surplus of fuel is produced while the fuel pump motor slows down to the current demands of the system. Thus, the amount of fuel supplied by the fuel pump is not always accurate and can result in either too little or too much fuel being supplied to the injectors. The problem with too much fuel being supplied to the injectors is that the engine is subject to undesired acceleration.

Recent emphasis has been placed on increasing the sophistication of fuel pump control systems to ensure that fuel demands are met with little or no latency periods between demand and supply. These control systems tend to be complex, expensive, and require additional installation procedures and maintenance. Furthermore, these significantly complex controls systems are prone to malfunction.

An example of such a fuel pump control system is disclosed in U.S. Pat. No. 4,789,308 to Tuckey. Tuckey discloses a pressure control device for maintaining a substantially constant pressure in the fuel delivery line. Tuckey provides a pressure sensor 60 in fuel pump housing 18 to sense the amount of pressure in housing 18 surrounding a fuel pump armature 22 of the fuel pump motor. The amount of current sent to armature 22 is controlled according to the amount of pressure in the fuel pump. Pressure sensor 60 comprises a piston 64 formed of a permanent magnet and a connected coil spring 68 and a sleeve bearing within bore 62 within which piston 64 moves according to the differential pressure between the fuel pressure exerted on one side of piston 64 and the spring pressure exerted by spring 68 on the other side of piston 64. As the position of piston 64 varies, a corresponding change is produced in the magnetic field strength which is sensed by a Hall-effect sensor 72. This change in field strength at sensor 72 causes a change in a electrical output of sensor 72 to amplifier 74. The signal from amplifier 74 continuously varies the amount of current supplied to armature 22, thus controlling the amount of fuel being pumped out of the fuel pump.

Another example of a fuel pump control system is disclosed in U.S. Pat. No. 4,728,264 to Tuckey. Tuckey discloses a fuel delivery system having a fuel pressure regulator 20 located within fuel pump 14 and comprising a pressure sensitive electrical switch and a flexible diaphragm 38 and connected coil spring 42. Diaphragm 38 is a first electrical contact for switch 20 and feeds power from a battery to a fuel pump motor 16. When the fuel pressure from the output of pump 14 overcomes the force of spring 42, electrical contact between diaphragm 38 and fuel pump motor 16 is cut to turn off fuel pump motor 16. Tuckey also includes an embodiment where a piston and spring assembly is used in place of the diaphragm.

A further example of a fuel pump control system is disclosed by Schillinger in U.S. Pat. No. 4,260,333. Schillinger discloses a fuel pump system where the fuel pressure in the fuel delivery system is monitored and the power to the fuel pump is changed corresponding to the sensed pressure to prevent excess fuel from being sent to injectors and then being sent back to the fuel pump reservoir.

Another example of a fuel delivery control system is disclosed by Tuckey in U.S. Pat. No. 4,926,829 in which a restriction device is set up in the fuel line to restrict the back flow of fuel thereby creating a back flow pressure. The fuel pump motor speed is reduced as back flow pressure increases and is reduced as back flow pressure decreases.

A final example of a fuel delivery control system is disclosed by Cummins et al. in U.S. Pat. No. 4,756,291. Cummins et al. provide an electric fuel pump which provides fuel in accordance with the electric power applied to the pump. Cummins et al. also provide a control circuit which compares a fuel pressure in a fuel delivery line with a predetermined pressure range. If the pressure falls below a predetermined value, electric power applied to the fuel pump is increased by a predetermined amount to increase the pressure, also by a predetermined amount.

As seen from the above discussion, the fuel delivery control systems of the prior art are complicated and require pressure sensors and control circuits. Further, these inventions all seek to control the fuel pump motor to ensure that fuel demands are timely met despite the fact that it is very difficult to totally overcome the inherent latency period in any type of fuel pump motor.

OBJECTS OF THE INVENTION

An object of the present invention is to provide an improved fuel delivery system without the use of a complicated fuel delivery control system.

Another object of the present invention is to provide a simple and inexpensive device for stabilizing fuel flow.

A further object of the present invention is to provide a fuel flow stabilizing device which reduces the response requirements of a fuel pump.

Another object of the present invention is to provide an apparatus which allows for increased latency time of a fuel pump without a loss of fuel delivery performance.

An additional object of the present invention is to provide a fuel flow stabilizing device which allows for a simple fuel pump motor controller to be used in a fuel delivery system without a reduction in the timeliness of fuel delivery.

Another object of the present invention is to provide a fuel delivery apparatus which immediately provides the appropriate amounts of fuel in response to sudden deceleration or acceleration.

These and other objects, features, and advantages will become apparent to those skilled in the art from the following detailed description when read in conjunction with the accompanying drawings and appended claims.

According to a broad aspect of the present invention, a fuel delivery system is provided for use with an engine. The fuel delivery system includes a fuel pump for delivering fuel along a fuel line to either fuel injectors or a carburetor of the engine. A fuel flow stabilizing device is provided in the fuel delivery system and can be positioned in the fuel pump, the fuel tank, the carburetor or fuel injectors or anywhere along the fuel delivery line.

The stabilizing device can be in the form of an accumulator which accumulates and stores excess fuel. The accumulator can be a piece of expansible tubing with an air bubble therein or something more elaborate such as a bladder. The stabilizing device can also be a sealed or unsealed tank depending on the design of the bladder and the volume of the stabilizing device required. Further, the stabilizing device can be a sealed container with air of some other gas inside which is compressed and expanded depending on the pressure exerted by the fuel in a fuel delivery line. The accumulator could also include a membrane placed between the gas (air) and the fuel to keep the gas (air) from being adsorbed into the liquid fuel. The accumulator could also comprise a diaphragm or piston with an attached spring to expand and compress according to the pressure of the fuel.

Regardless of the particular form, the accumulator contains a reserve amount of fuel. The particular amount of reserve fuel is determined according to the requirements of the fuel delivery system. When a rapid increase in fuel is demanded, the pressure provided within the accumulator forces the necessary portion of reserve fuel into the fuel delivery line to compensate for the latency period of the fuel pump motor. That is, the fuel pump motor may require several hundred milliseconds to achieve a sufficient speed to deliver the necessary amount of fuel. The extra fuel provided by the accumulator compensates for the initial start-up deficiency of the fuel pump and ensures the proper amount of fuel is provided in immediate response to the demand. When the fuel pump motor reaches the required fuel pump speed, fuel from the accumulator is no longer provided and the pressure in the fuel line prevents further fuel from the accumulator from being introduced into the fuel delivery line. Similarly, when a sudden deceleration occurs, the accumulator absorbs excess fuel until the pump slows down to the current demands of the fuel system.

In the embodiment of the present invention where air is provided in the accumulator device without an adsorption preventing membrane, means for automatically replenishing air which is adsorbed by the liquid fuel air can be provided. The means for automatically replenishing air allows air from an air source to enter the fuel flow stabilizing chamber when the fuel delivery system is turned off. The air could come from the fuel tank which would allow the system to remain closed.

It may also be beneficial to install a relief valve in the system for both safety concerns and to provide a means of reverting back to existing methods to enable a limp mode of operation. In such a limp mode, the pump would normally be running at capacity with excess fuel returning to the tank. This fault condition is known by the controller and can be signaled to the operator via some communications channel such as a multiplexer in the form of a mux or an indicator light. This condition can also be detected by monitoring the vent outlet of the relief valve. This method allows system operation in case of a sensor failure. System electronics warn the operator of system performance failure by several different means.

The system could also operate by monitoring the over pressure outlet of the relief valve. This allows the controller to maintain a minimum flow from the vent outlet to the tank minimizing temperature rise of the fuel vent under fault conditions. This sensing of the vent could be accomplished with a switch or a pressure transducer.

DETAILED DESCRIPTION OF PREFERRED EMBODIMENTS

Figure 1:
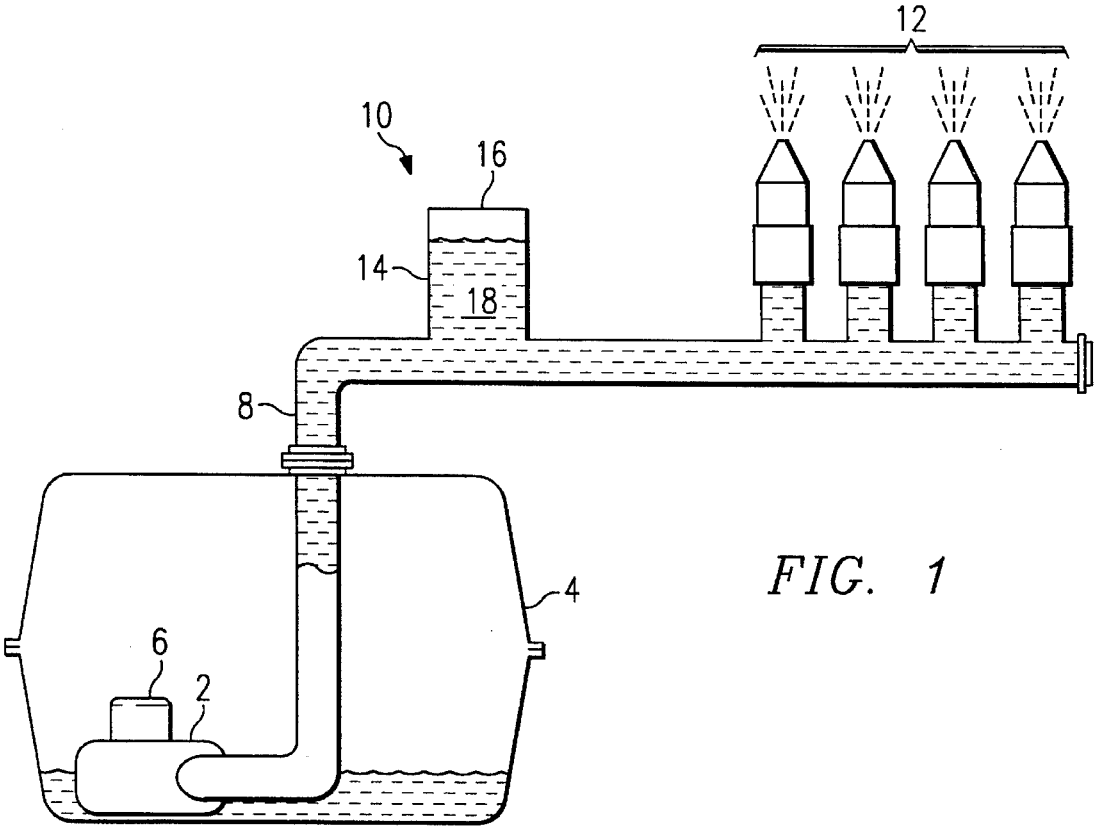
FIG. 1 is a schematic view of a fuel delivery system having a first embodiment of the fuel flow stabilizing device of the present invention.
Figure 2:
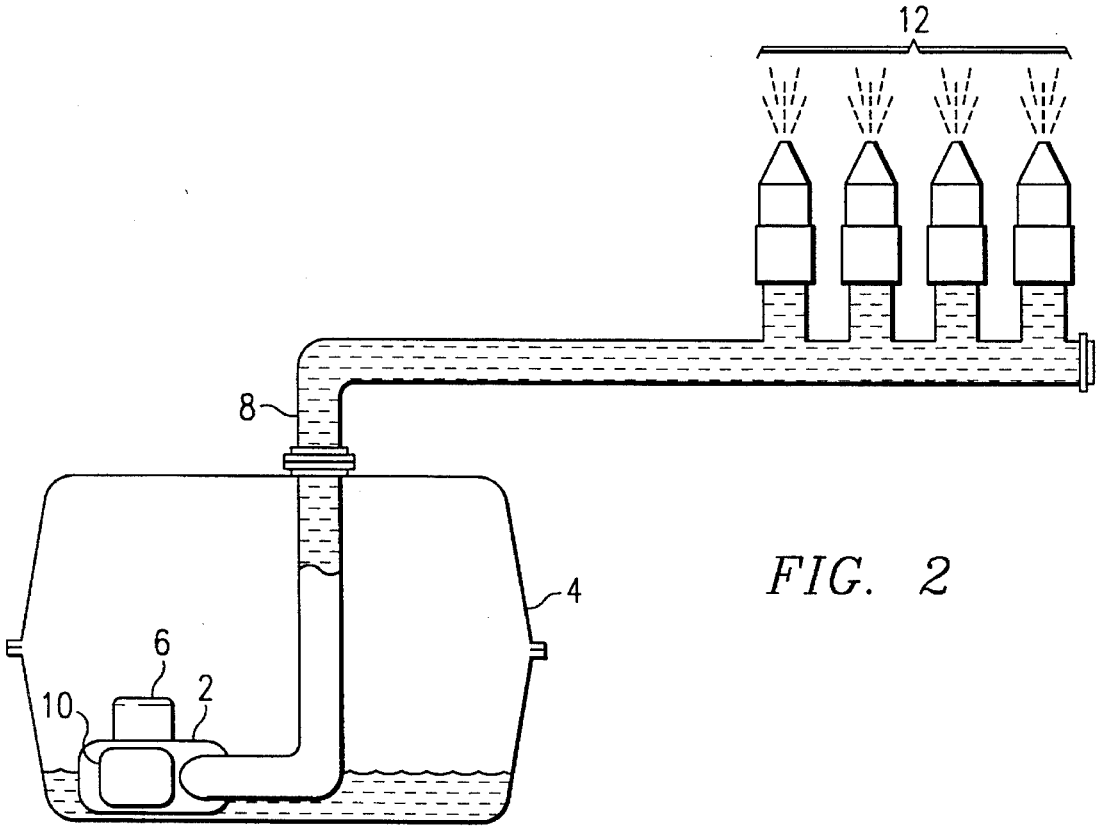
FIG. 2 is a schematic view of a modification of the fuel delivery system of FIG. 1 in which the accumulator is located in the fuel pump.
Figure 3:
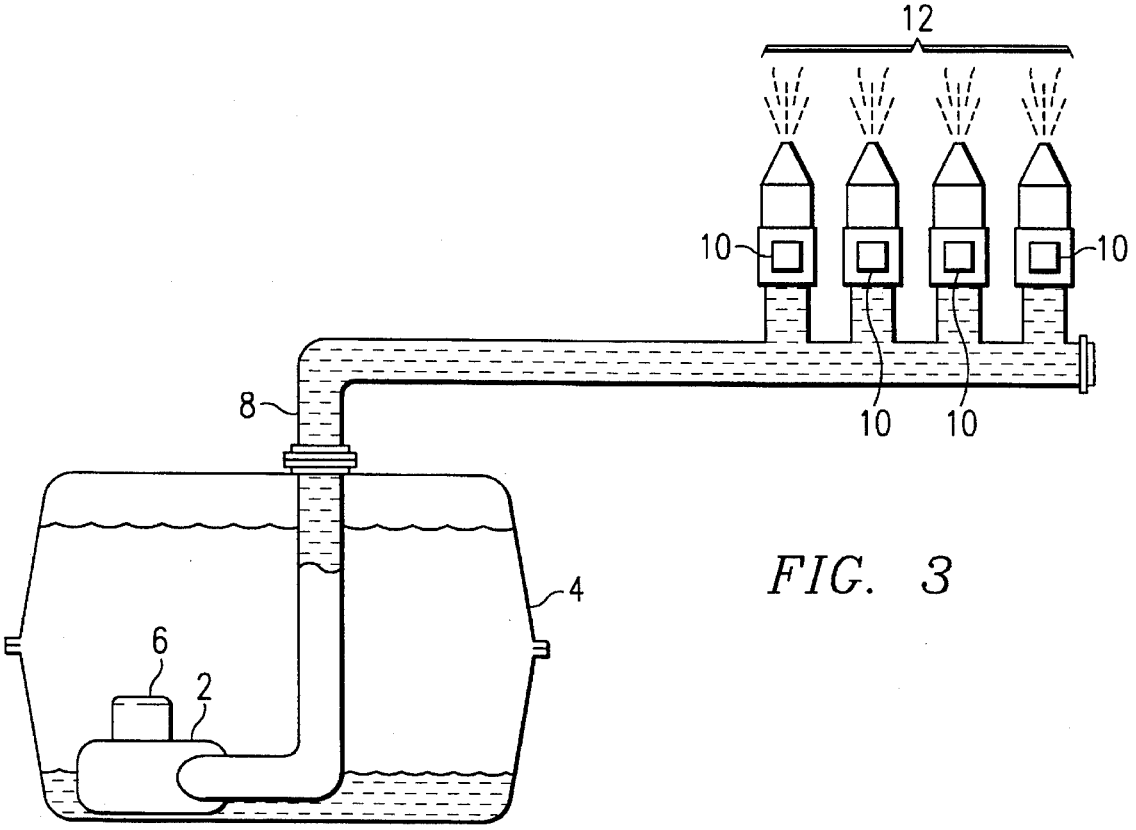
FIG. 3 is a schematic view of a modification of the fuel delivery system of FIG. 1 in which the accumulator is located in the fuel injector.
Figure 4:
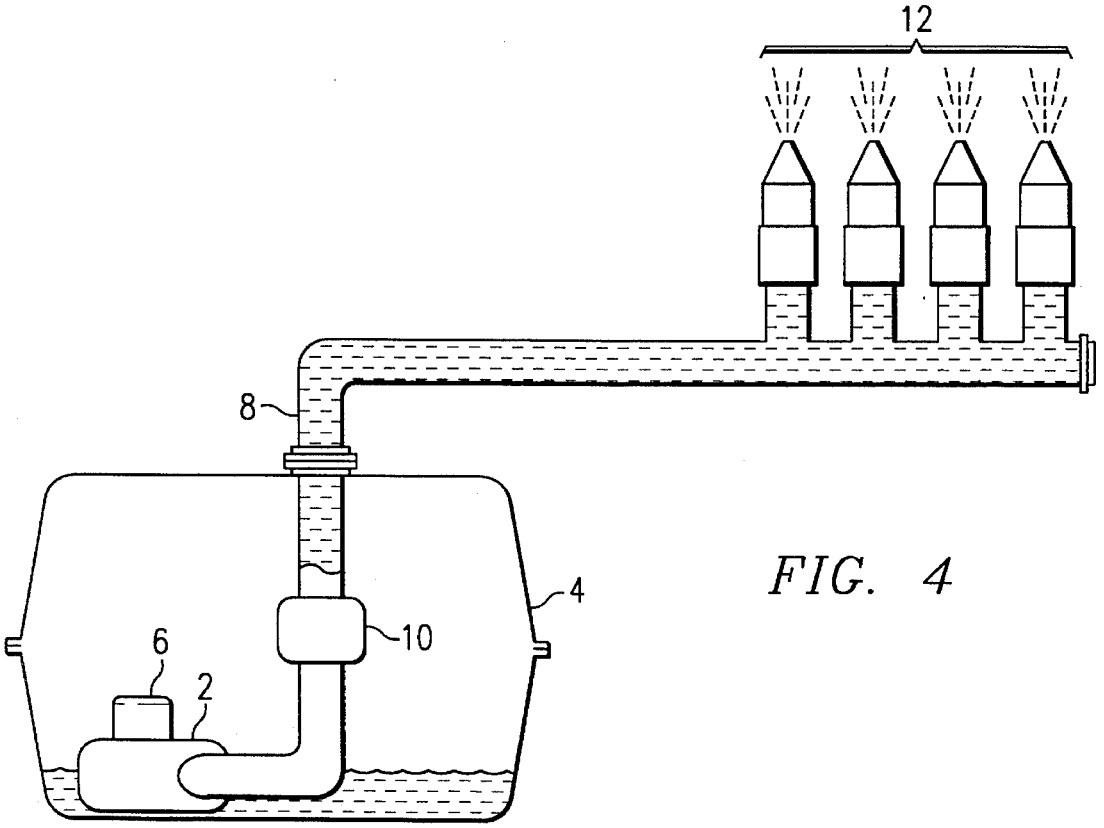
FIG. 4 is a schematic view of a modification of the fuel delivery system of FIG. 1 in which the accumulator is located in the fuel tank.

FIG. 1 illustrates a first preferred embodiment of the fuel delivery system of the present invention for use in an engine. The fuel delivery system includes a fuel pump 2 located in a fuel tank 4 and having an electronic fuel pump motor 6 contained therein. Fuel pump 2 is connected to the beginning of a fuel delivery line 8 which extends from fuel pump 2 to a plurality of fuel injectors 12. Positioned along fuel delivery line 8 is an accumulator 10 which can also be positioned in fuel pump 2 as shown in FIG. 2, in each of the fuel injectors 12 as shown in FIG. 3, or in fuel tank 4 as shown in FIG. 4. Accumulator 10 shown in FIGS. 3–5 can be in the form of one of the types of accumulators described below.

In the embodiment of FIG. 1, accumulator 10 includes an expansible tubing member 14 having an air bubble 16 and a reserve amount of fuel 18 contained therein. Air in air bubble 16 is compressed or expanded according to the various pressure changes in fuel delivery line 8. For example, if the engine is suddenly accelerated, there is a sudden large demand for fuel caused by rapid and expansive opening of fuel injectors 12. Such an opening of injectors 12 results in all of the fuel in fuel delivery line 8 being supplied to injectors 12 and a resulting loss in pressure in fuel delivery line 8. Fuel pump motor 6 may not be able to operate fuel pump 2 quickly enough to supply all of the sudden large demand to injectors 12. When a pressure in fuel delivery line 8 decreases, air in air bubble 16 expands to force reserve fuel 18 into fuel delivery line 8 to compensate for the latency period of fuel pump 2. Accumulator 10 ensures sufficient fuel is immediately supplied to injectors 12 despite a delay in fuel pump 2 reaching a required pumping capacity. Once the fuel pump reaches a required pumping capacity and the reserve fuel 18 is replenished to the original level, the pressure of the air in air bubble 16 is equal to the pressure of the fuel in fuel line 8. Because of this pressure equilibrium, no more fuel from reserve 18 is supplied to fuel line 8.

Accumulator 10 also allows for a simpler fuel pump 2 and fuel pump motor 4 to be used, as the response time requirements for fuel supplying are substantially reduced. That is, fuel pump 2 is not required to immediately provide the exact amount of fuel demanded as fuel reserve 18 makes up for any deficiency cause by a latency period of fuel pump 2. The amount fuel and pressure which must be provided by air bubble 16 depends on the size and capacity of accumulator, which is designed according to the particular fuel delivery system in which it is implemented.

Figure 5:
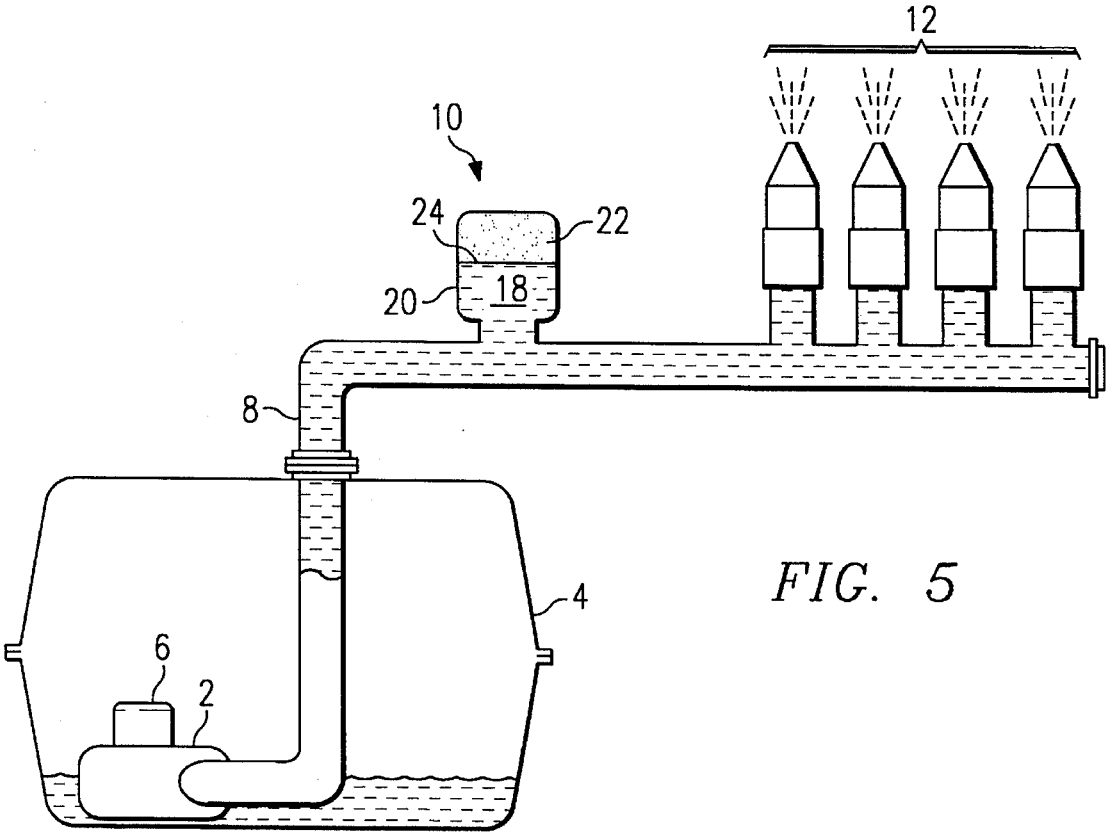
FIG. 5 is a schematic view of a fuel delivery system having a second embodiment of the fuel flow stabilizing device of the present invention.
Figure 6:
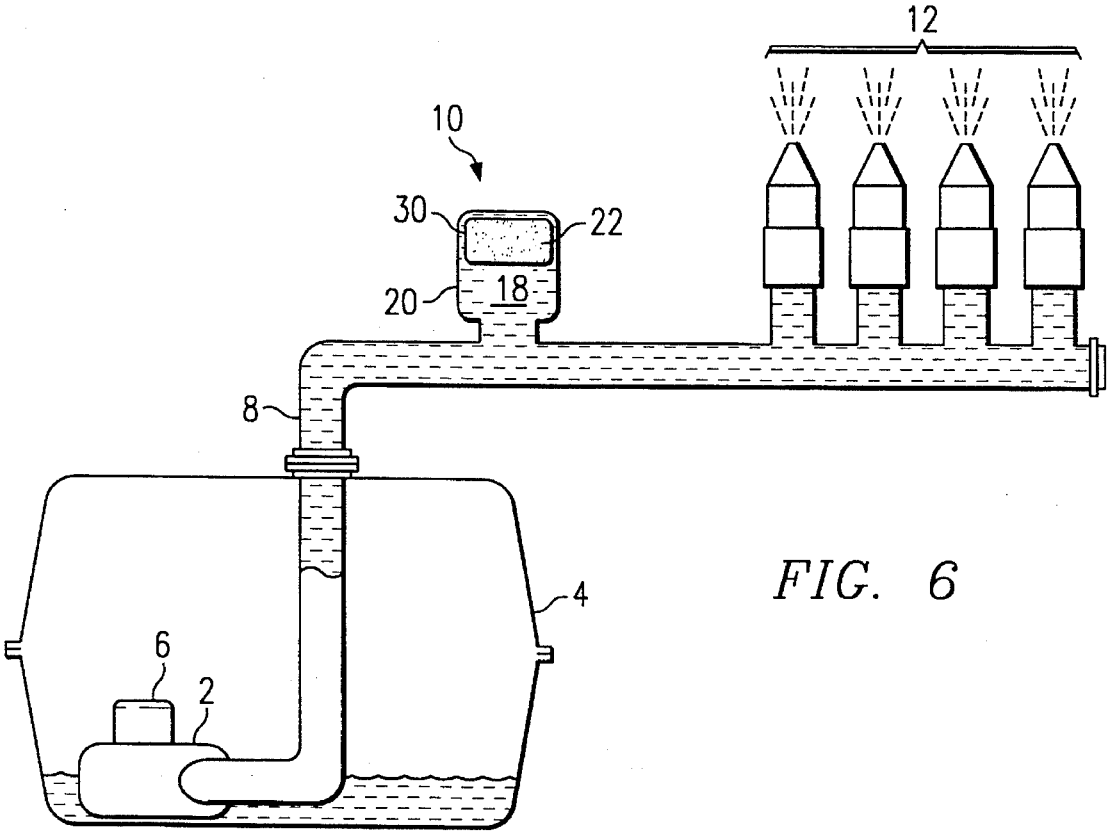
FIG. 6 is a schematic view of a fuel delivery system having a third embodiment of the fuel flow stabilizing device of the present invention.

FIG. 5 depicts a second embodiment of the present invention wherein parts corresponding to those in FIG. 1 are denoted with the same reference numerals. Accumulator 10 in FIG. 5 comprises a sealed tank 20 having fuel reserve 18 and a supply of compressible gas 22 contained therein. Also provided in tank 20 is a membrane 24 for preventing compressible gas from being adsorbed in the liquid fuel of fuel reserve 18. However, membrane 24 allows for compressible gas to be compressed and expanded as describe above. As shown in FIG. 6, compressible gas 22 could also be provided in a bladder 30 and therefore, membrane 24 would not be required. Bladder 30 is responsive to pressure provided by fuel in fuel line 8 and compresses and expands without allowing gas to be adsorbed into the liquid fuel as in the second embodiment.

Figure 7:
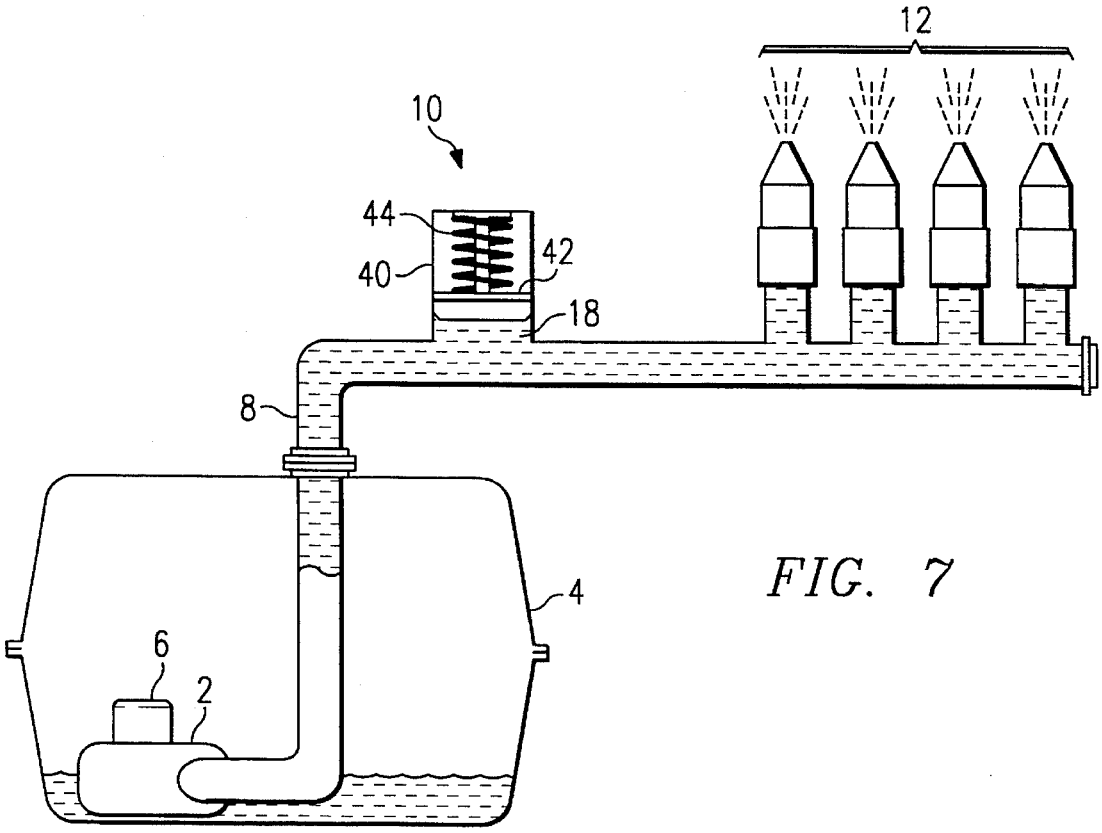
FIG. 7 is a schematic view of a fuel delivery system having a fourth embodiment of the fuel flow stabilizing device of the present invention.

A fourth embodiment of the present invention is illustrated in FIG. 7 in which pressure in accumulator 10 is provided by a spring 44 rather than by a compressible gas. Accumulator 10 of the fourth embodiment comprises a housing 40 having reserve fuel 18, a piston 42 and a coil spring 44 contained therein. Coil spring 44 is attached to piston 42 to force piston 42 against the pressure of the fuel in fuel delivery line 8. The constant of elasticity K for spring 44 is selected so as to maintain piston 42 in a neutral position when a pressure in fuel delivery line is at a predetermined value. Similar to the previously described embodiments, as fuel pressure in fuel delivery line 8 decreases below the predetermined value, spring 44 expands to force piston 42 to force fuel from fuel reserve 18 into fuel delivery line 8. Also, when fuel pressure in fuel delivery line 8 increases beyond a predetermined value, spring 44 is compressed to allow piston 42 to be forced upwardly in housing 40 by pressure in fuel delivery line. Thus, excess fuel is accommodated in fuel reserve 18 of housing 40 to compensate for the latency period of pump motor 6.

Figure 8:
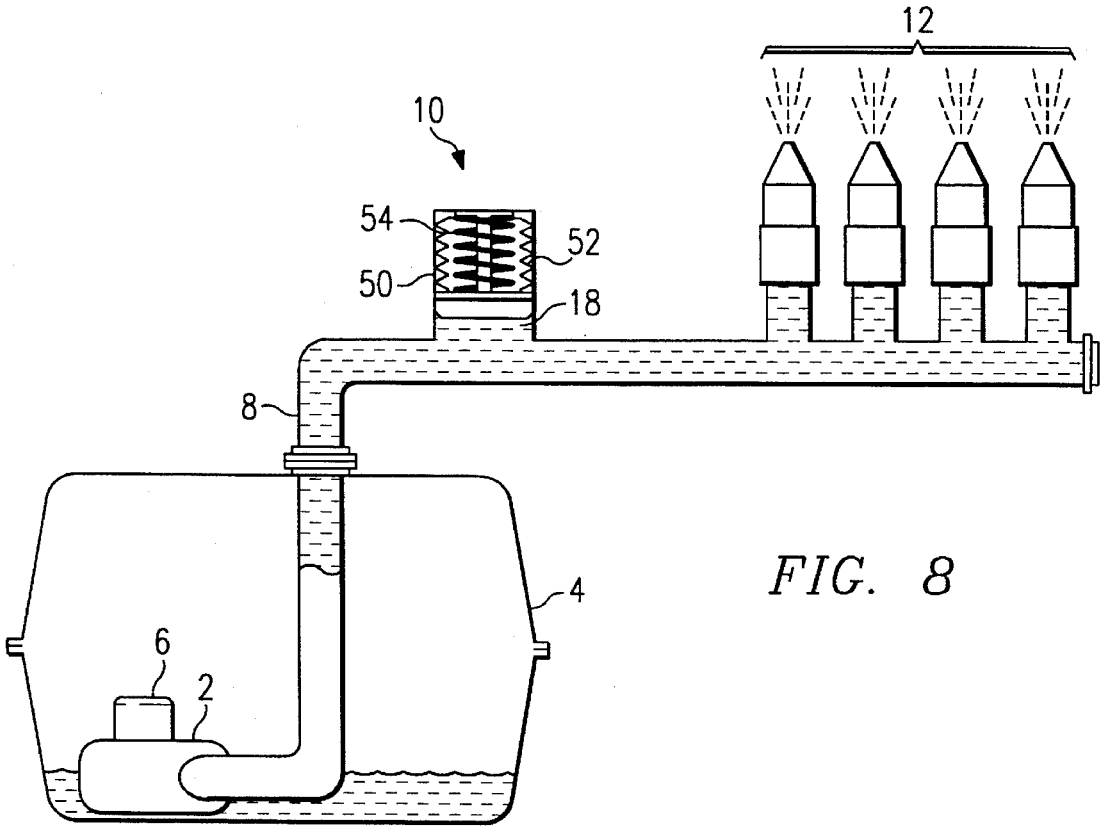
FIG. 8 is a schematic view of a fuel delivery system having a fifth embodiment of the fuel flow stabilizing device of the present invention.

FIG. 8 depicts a fifth embodiment of the present invention which is similar to the fourth embodiment. Instead of piston 42, an expandable and compressible bellows 52 is provided in housing 50 with a spring 54 provided inside bellows 52. The spring constant for spring 54 is selected as previously described. Bellows 52 and spring 54 operate just as piston 42 and spring 44 operate as described above.

Figure 9:
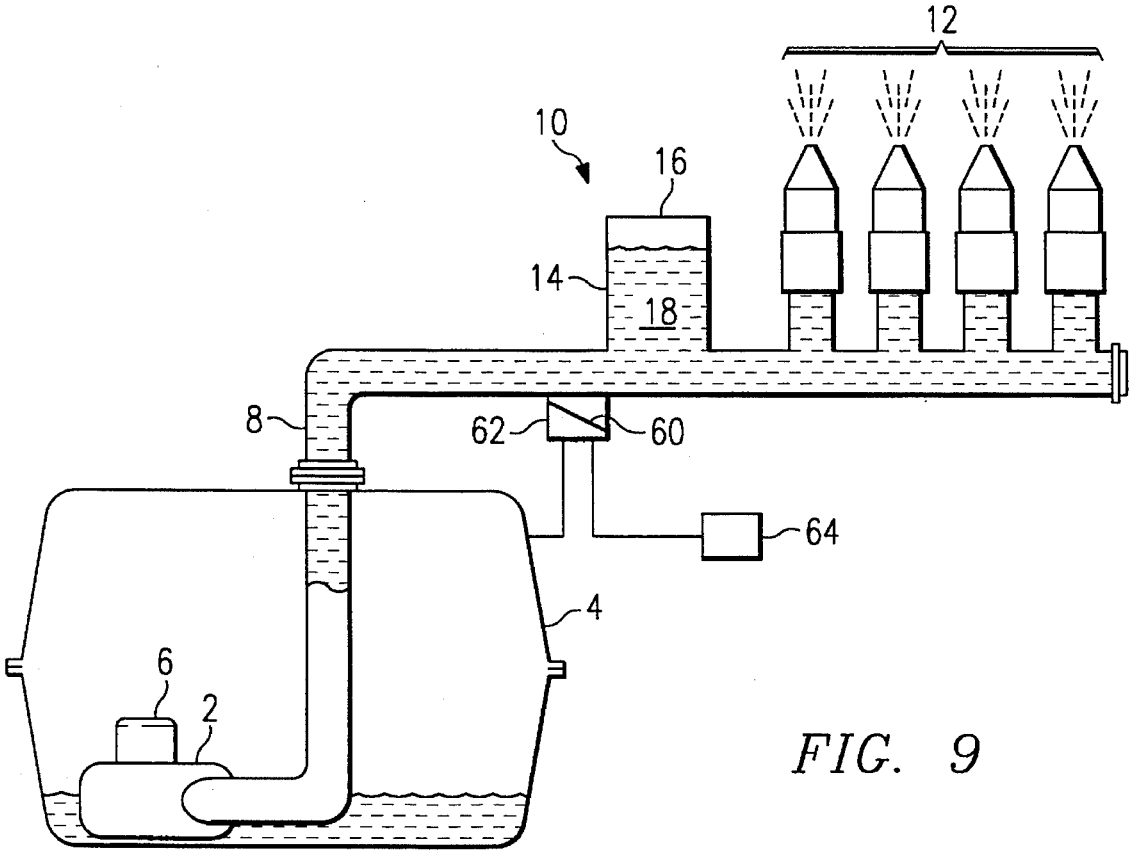
FIG. 9 is a schematic view of a fuel delivery system having a sixth embodiment of the fuel flow stabilizer device of the present invention.

FIG. 9 illustrates a sixth embodiment of the present invention having an accumulator device 10 similar to that shown in FIG. 1. This embodiment includes a relief valve 60 in the form of a vent outlet or a pressure outlet which can be a spring loaded valve or diaphragm relief valve 60 is set to allow fuel to return to the fuel tank when a certain threshold fuel pressure has been exceeded. Relief valve 60 includes a sensor 62 for sensing when the predetermined threshold pressure has been reached and an indicator 64 for indicating when the excess fuel is returning to the fuel tank. The sensor 62 can be in the form of a switch or a transducer. The indicator 64 can be in the form of a multiplexer or an indicator light.

The invention has been described with reference to the preferred embodiments thereof, which are illustrative and not limiting. Various changes may be made without departing from the spirit and scope of the invention as defined in the appended claims.

What is claimed is:

1. A fuel supply system for supplying liquid fuel to an engine of the type in which the fuel is delivered to said engine by fuel injectors, comprising:

a fuel pump;

a fuel delivery line connected between said fuel pump and said fuel injectors;

an accumulator in said fuel delivery line for accumulating a reserve amount of fuel in ordinary operation for ensuring that said fuel delivery line instantaneously supplies a required amount of fuel to the injectors in response to a sudden demand for additional fuel, said accumulator comprising a sealed tank containing said reserve amount of fuel and an amount of air that expands and compresses in response to pressure exerted by fuel in said fuel line; and means for resupplying air from a fuel tank to said accumulator when said fuel supply system is inoperative;

wherein said accumulator supplies fuel from said reserve amount of fuel to said fuel line in response to a sudden demand for fuel which cannot immediately be satisfied by said fuel pump;

and wherein said accumulator receives excess fuel from said fuel line in response to a sudden decrease in the demand for fuel which cannot be satisfied by said fuel pump.

2. The fuel supply system of claim 1, wherein said sealed tank comprises a membrane for preventing the air from being adsorbed in said liquid fuel.

* * * * *